US009322285B2

(12) United States Patent
Devore et al.

(10) Patent No.: US 9,322,285 B2
(45) Date of Patent: Apr. 26, 2016

(54) LARGE FILLET AIRFOIL WITH FANNED COOLING HOLE ARRAY

(75) Inventors: Matthew A. Devore, Manchester, CT (US); Corneil S. Paauwe, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 2537 days.

(21) Appl. No.: 12/033,918

(22) Filed: Feb. 20, 2008

(65) Prior Publication Data

US 2009/0208325 A1 Aug. 20, 2009

(51) Int. Cl.
*F01D 9/04* (2006.01)
*F01D 5/18* (2006.01)

(52) U.S. Cl.
CPC ..... *F01D 9/041* (2013.01); *F01D 5/186* (2013.01); *F05D 2240/121* (2013.01); *F05D 2240/303* (2013.01); *F05D 2240/81* (2013.01); *F05D 2260/202* (2013.01)

(58) Field of Classification Search
CPC ... F01D 9/041; F01D 5/186; F05D 2240/121; F05D 2240/303; F05D 2240/81; F05D 2260/202
USPC ..... 415/115, 191, 211.2
See application file for complete search history.

(56) References Cited

U.S. PATENT DOCUMENTS

| | | | | |
|---|---|---|---|---|
| 4,105,364 | A | 8/1978 | Dodd | |
| 4,712,979 | A | 12/1987 | Finger | |
| 5,344,283 | A | 9/1994 | Magowan et al. | |
| 5,394,687 | A | 3/1995 | Chen et al. | |
| 5,762,471 | A | 6/1998 | Cunha | |
| 5,993,156 | A | 11/1999 | Bailly et al. | |
| 6,036,436 | A | 3/2000 | Fukuno et al. | |
| 6,190,128 | B1 * | 2/2001 | Fukuno et al. | 416/96 R |
| 7,025,563 | B2 | 4/2006 | Servadio et al. | |
| 7,281,895 | B2 | 10/2007 | Liang | |
| 7,322,796 | B2 | 1/2008 | Pietraszkiewicz et al. | |
| 7,621,718 | B1 * | 11/2009 | Liang | 415/115 |
| 7,625,181 | B2 * | 12/2009 | Matsuda et al. | 416/193 A |
| 2006/0083613 | A1 * | 4/2006 | Cunha et al. | 416/97 R |
| 2006/0127220 | A1 * | 6/2006 | Lee | 416/97 R |
| 2007/0081890 | A1 * | 4/2007 | Lutjen et al. | 415/115 |

* cited by examiner

*Primary Examiner* — Dwayne J White
*Assistant Examiner* — Joshua R Beebe
(74) *Attorney, Agent, or Firm* — Carlson, Gaskey & Olds, PC

(57) ABSTRACT

A turbine airfoil has a fillet connecting the nominal portion of the airfoil into an end wall. Cooling holes are formed over a greater circumferential extent in the fillet than they are through the nominal portion of the airfoil.

7 Claims, 4 Drawing Sheets

LARGE FILLET AIRFOIL WITH FANNED COOLING HOLE ARRAY

This invention was made with government support under Contract No. N00019-02-N-3003 awarded by the United States Navy. The Government may therefore have certain rights in this invention.

BACKGROUND OF THE INVENTION

This application relates to an airfoil utilized in a gas turbine engine component.

Gas turbine engines typically include a plurality of sections mounted in series. A fan may deliver air to a compressor section. The compressor section compresses that air and delivers it into a combustion section at which it is mixed with fuel and combusted. Products of this combustion pass downstream over turbine rotors, and through turbine vanes. The rotors are driven to rotate by the products of combustion. Typically, the vanes include airfoils fixed between opposed radially inward and radially outward end walls. Since the vanes are mounted in the path of the products of combustion, they are subject to extremely high temperature. Thus, cooling air is typically delivered within the airfoil, and circulated to various locations on the skin of the vanes. One location to which the cooling air is directed is through a so-called showerhead array of cooling holes on a leading edge of the airfoil.

Typically, the airfoil merges into the end walls with only a very small radius of curvature, or fillet. Thus, the connection of the airfoil into the end wall could be approximated as less than 5% of the radial span of the airfoil. In such components, a flow field phenomenon known as a "bow wake" occurs wherein air has a negative pressure gradient. The gradient transports hot mid span gases onto the end wall. To address the bow wake, additional cooling holes have been formed in the end wall.

Another type of airfoil has a so-called "large fillet," or curve, merging the airfoil into the end walls. As an example, the large fillet would extend over more than 5% of the radial length of the airfoil. With such an airfoil, the effect of bow wake is reduced or eliminated. The known large fillet airfoils have typically included a showerhead that extends through the radial extent of the airfoil.

SUMMARY OF THE INVENTION

In a disclosed embodiment of this invention, a large fillet airfoil is provided with a fanned cooling hole array in the fillet area. The cooling holes fan circumferentially outwardly from a showerhead such that a larger surface area is covered in the fillet.

These and other features of the present invention can be best understood from the following specification and drawings, the following of which is a brief description.

DETAILED DESCRIPTION OF THE PREFERRED EMBODIMENT

Figure 1:
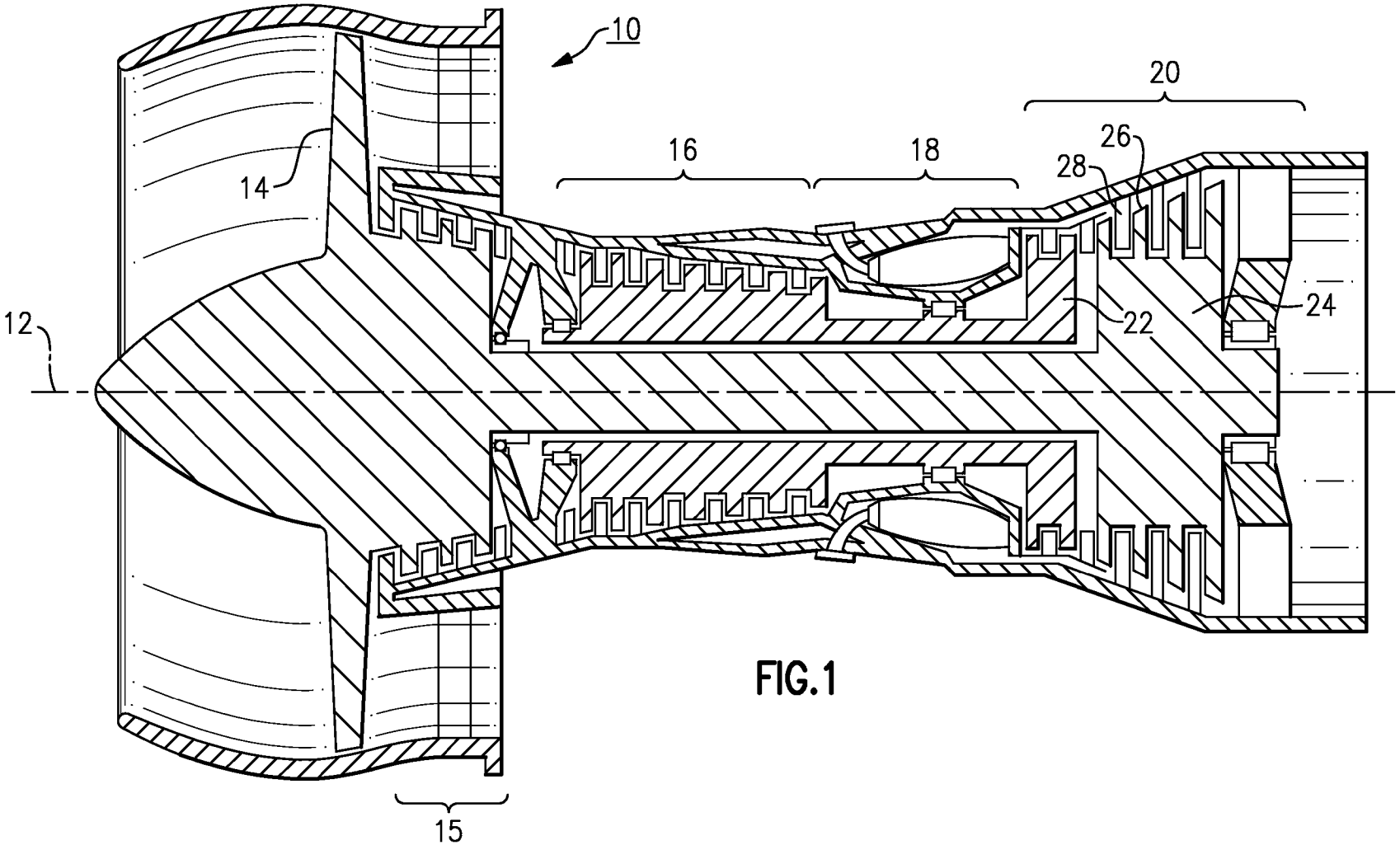
FIG. 1 shows an example gas turbine engine.

A gas turbine engine 10, such as a turbofan gas turbine engine, circumferentially disposed about an engine centerline, or axial centerline axis 12 is shown in FIG. 1. The engine 10 includes a fan 14, compressor sections 15 and 16, a combustion section 18 and a turbine 20. As is well known in the art, air compressed in the compressor 15/16 is mixed with fuel and burned in the combustion section 18 and expanded in turbine 20. The turbine 20 includes rotors 22 and 24, which rotate in response to the expansion. The turbine 20 comprises alternating rows of rotary airfoils or blades 26 and static airfoils or vanes 28. In fact, this view is quite schematic, and blades 26 and vanes 28 are actually removable. It should be understood that this view is included simply to provide a basic understanding of the sections in a gas turbine engine, and not to limit the invention. This invention extends to all types of turbine engines with axial turbines for all types of applications.

Figure 2:
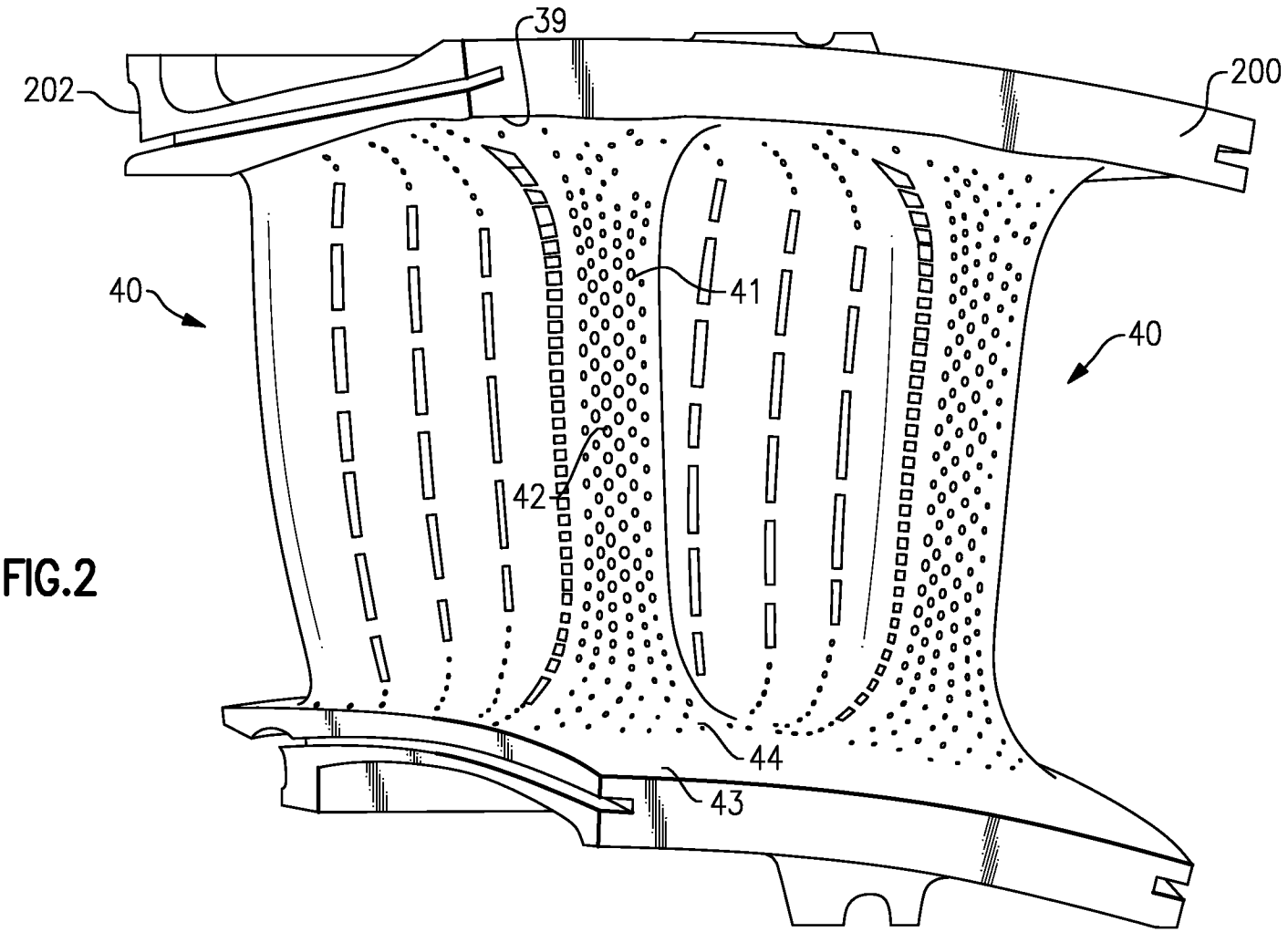
FIG. 2 is a perspective view of a vane from the gas turbine engine of FIG. 1.

As shown in FIG. 2, one type of vane is a vane 40 provided with a large fillet. The large fillet 44 is formed to connect an airfoil 41 into end walls 43 and 39. As shown, a nominal portion of the airfoil 41 merges into end wall 43 through the large fillet 44. An upstream end 200 of the vane is shown, as is a downstream end 202 for orientation. As can be appreciated from FIG. 2, essentially, the large fillet 44 curves upstream from the airfoil 41 into the end walls 43 and 39, and also curves circumferentially to each side of the airfoil 41.

Figure 3:
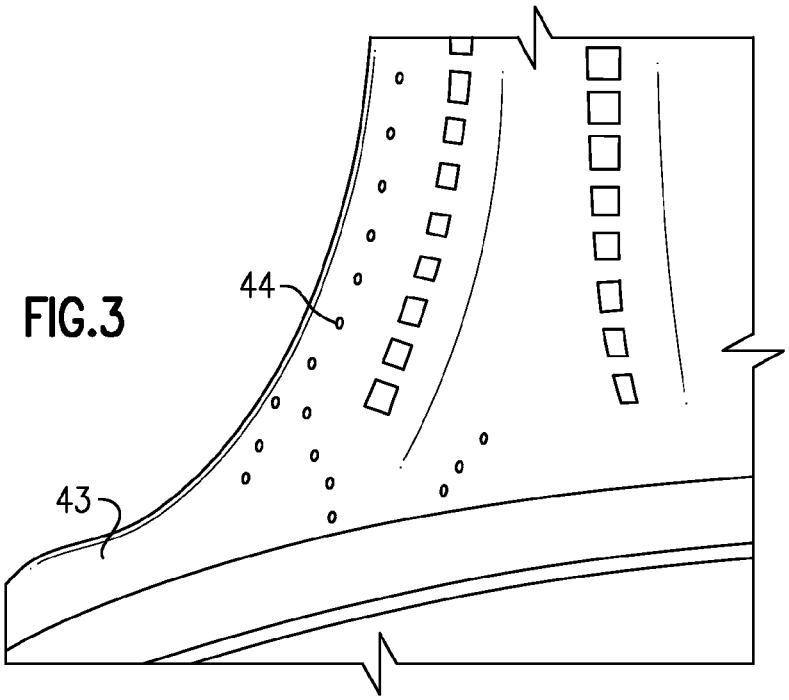
FIG. 3 is a side view of a large fillet airfoil.
Figure 4:
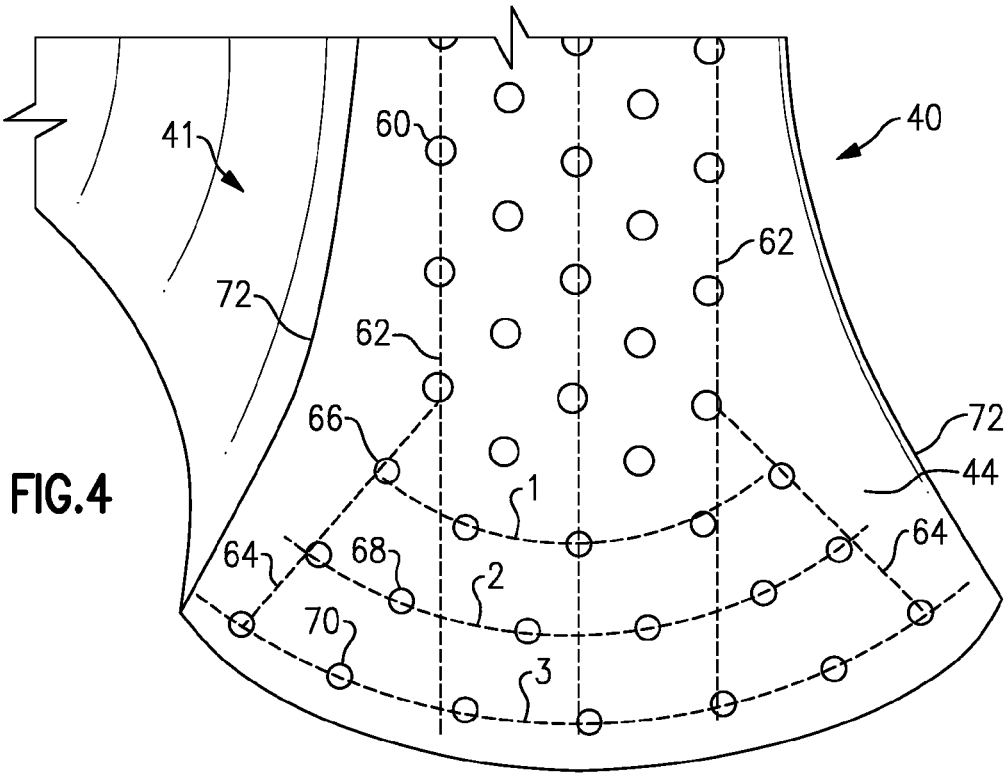
FIG. 4 shows a cooling hole array in a large fillet airfoil.

As shown in FIG. 3, the large fillet extends for a relatively great amount of a radial extent of the airfoil. For purposes of this measurement, the large fillet is treated as part of the radial extent of the airfoil. As shown in FIG. 3, the fillet 44 extends for approximately 25% of the overall radial extent, or span. Of course, this amount is only one example. The term "large fillet" can be taken as anything over 5% of the span, As shown in FIG. 4, the vane 40 includes the airfoil 41 merging into the large fillet 44. So-called showerhead holes 60 extend through the airfoil portion 41. As can be appreciated, the showerhead holes 60 tend to extend through several rows spaced circumferentially by a small amount. Planes 62 can be defined by each circumferentially outermost row of showerhead holes 60.

As can be appreciated from FIG. 4, within the large fillet 44, additional holes are formed. Holes fan circumferentially outwardly in both directions to define planes 64. Several rings can be defined including rings 1, 2, and 3 as illustrated in FIG. 4, and each ring includes more holes in the large fillet than the prior ring. Thus, five holes 66 are illustrated in ring 1, with 6 holes 68 in ring 2, and 7 holes 70 in ring 3. Of course, any number of holes can be utilized. In fact, the holes need not be arranged in rings. The main feature is to fan the holes circumferentially outwardly towards the curved sides 72 of the large fillet and beyond the planes 62 defined by the showerhead holes. In addition, as can be appreciated, the holes 66, 68, and 70 are staggered, such that they will cover a larger circumferential portion of the surface area.

In addition, the size of the holes in the large fillet 44 may be smaller than the holes in the airfoil 41. The large fillet 44 will likely be dealing with cooler gasses than will the area having the showerhead, and thus the smaller holes may be acceptable. On the other hand, all holes could be the same size. Also, the holes in the large fillet 44 could be larger than those in airfoil 41. The size of the holes is a function of how much cooling is required given the radial temperature profile from the products of combustion to which the airfoil is exposed. Also, manufacturing capabilities and gross size of the airfoil do come into play as well. Because end walls are typically cooler then the mid span, an optimized design may have the holes become smaller as you approach the end wall.

Figure 5:
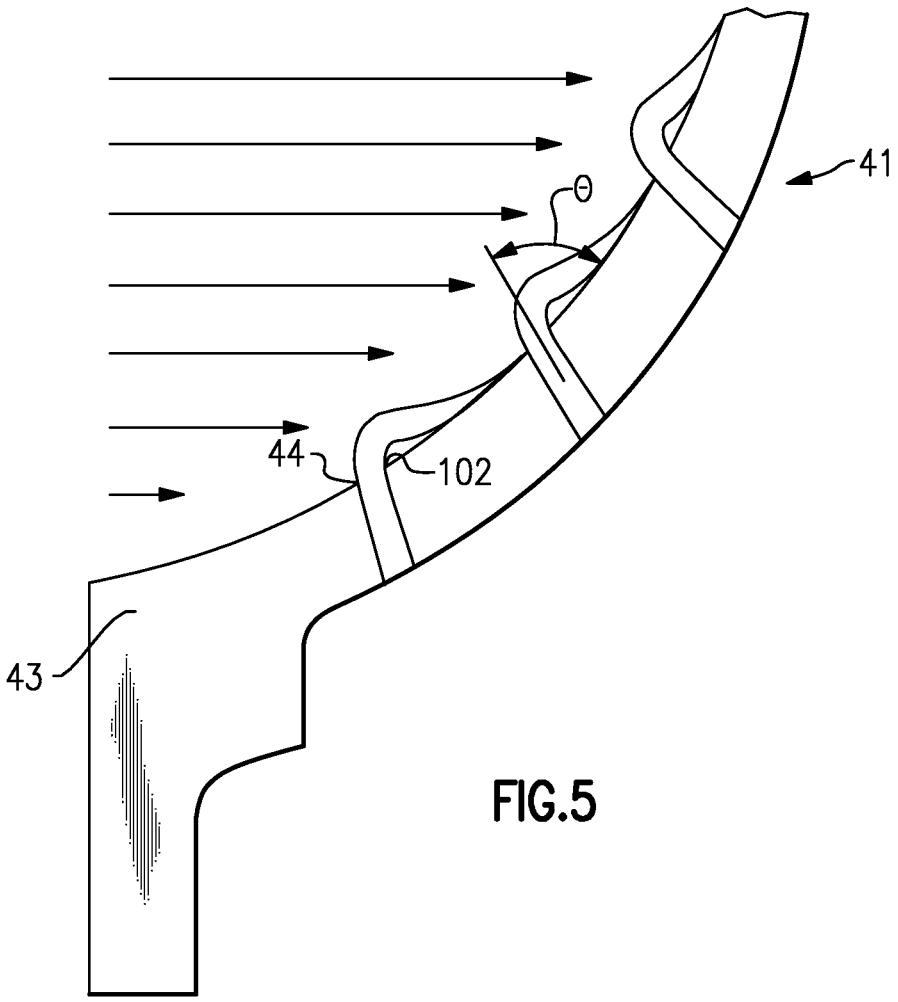
FIG. 5 is a cross-sectional view through a portion of the large fillet.

FIG. 5 shows another feature, wherein the holes 102 in the fillet 44 can be seen to exit at an angle θ such that the exiting air is driven back against the outer skin of the large fillet by the products of combustion approaching the airfoil 41. Holes may exit the fillet at any angle but to reduce blow off and thus increase film adhesion and to increase the internal surface area of the film hole, the optimal configuration is to produce an array with the shallowest surface angles. This angle θ is shown as being less than 90° to achieve this benefit.

Film hole exit diffusion can be used to further enhance film effectiveness. This could include something other than constant cross section round holes. Instead, the holes can have something like a simple or compound angles to provide a diffusion angle.

The fanning of the cooling hole array provides convective cooling for the largest portion of the fillet volume and minimizes the amount of cooling required. It also allows for the greatest amount of overall film coverage due to hole staggering along streamlines.

In addition to cooling the airfoil, a potential benefit of the fillet cooling hole array, results from the additional air introduced near the end walls of the gas path. At these locations, a rich oxygen environment increases the likelihood that combustion is completed prior to entering the turbine. This has the potential to reduce the likelihood of unwanted downstream thermal phenomena when running at fuel rich operating points.

In sum, a large fillet merges an airfoil into an end wall for a gas turbine engine component. While disclosed in a turbine vane, the invention would extend to blades. While a double vane is shown, the invention also extends to single vanes. The large fillet is provided with a cooling hole array, which fans outwardly from a cooling hole array in a nominal portion of the airfoil. In this manner, the large fillet is provided with better cooling than was the case in the prior art.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine component comprising:

an airfoil extending through a radial extent, and having a nominal portion with a fillet merging into an end wall and a circumferential dimension defined between opposed side walls;

said fillet extending over a radial extent of greater than 5% of said radial extent of the airfoil; and cooling holes formed in said nominal portion and in said fillet, said cooling holes in said nominal portion extending for a first circumferential extent, and said cooling holes in said fillet extending for a second circumferential extent that is greater than said first circumferential extent.

2. The gas turbine engine component as set forth in claim 1, wherein said fillet curves in an upstream direction from said nominal portion, and also curves circumferentially outwardly to each side of said nominal portion to merge into said end wall.

3. The gas turbine engine component as set forth in claim 1, wherein said cooling holes in said fillet exit said fillet at an angle measured to a tangent of an outer surface of the fillet extending towards the nominal portion, with the angle being less than or equal to 90°.

4. The gas turbine engine component as set forth in claim 1, wherein said cooling holes in said fillet are formed in a plurality of radially spaced rings, with a radially spaced ring positioned closer to said end wall having more cooling holes than a radially spaced ring positioned further from said end wall.

5. The gas turbine engine component as set forth in claim 4, wherein there are at least three of said radially spaced rings, and a radially spaced ring closest to said end wall has more cooling holes than a radially spaced ring spaced at an intermediate distance from said end wall, and said radially spaced ring positioned at an intermediate distance has more cooling holes than a radially spaced ring spaced furthest from said end wall.

6. The gas turbine engine component as set forth in claim 1, wherein said cooling holes in said nominal portion have a larger cross-sectional area than said cooling holes in said fillet.

7. The gas turbine engine component as set forth in claim 1, wherein said component is a stationary vane for a turbine section.

* * * * *